United States Patent [19]

Pendergast

[11] Patent Number: 4,817,989

[45] Date of Patent: Apr. 4, 1989

[54] POSTCARD

[76] Inventor: William J. Pendergast, One Washington St., Suites 106–107, Wellesley, Mass. 02181

[21] Appl. No.: 129,242

[22] Filed: Dec. 7, 1987

[51] Int. Cl.[4] ..... B41L 1/20

[52] U.S. Cl. ..... 282/9 R; 229/92.8

[58] Field of Search ..... 229/92.8, 92, 69; 282/9 R

[56] References Cited

U.S. PATENT DOCUMENTS

| | | | |
|---|---|---|---|
| 1,886,669 | 11/1932 | Gillespie | 229/92.8 |
| 2,045,944 | 6/1936 | Domke | 229/92.8 |
| 2,148,887 | 2/1939 | Wanser | 229/69 X |
| 2,365,789 | 12/1944 | Weinschenk | 229/92.8 |
| 4,690,433 | 9/1987 | Showers et al. | 282/9 R |

*Primary Examiner*—Stephen Marcus
*Assistant Examiner*—Nova Stucker
*Attorney, Agent, or Firm*—Charles Hieken

[57] ABSTRACT

A postcard assembly comprising a first, second, and third sheet, the sheets being arranged one on top of another, with adjacent sheets removably attached together. The first and second sheets have first and second upper and first and second lower surfaces. The first and second lower surfaces comprise pressure sensitive material, wherein pressure on this material causes a visible mark to be formed on a sheet positioned below the first or second lower surface. The third sheet is adapted to be mailed as a postcard with the second sheet removably attached to the third sheet and with the second sheet obscuring any visible mark on the third sheet.

14 Claims, 2 Drawing Sheets

POSTCARD

BACKGROUND OF THE INVENTION

This invention relates to postcards having hidden messages.

Hager (Swiss Pat. No. 32728, 1905) describes a postcard having a single sheet of carbon paper held between two sheets. A third sheet is provided to allow a message to be written onto the sheet held against the marking side of the carbon paper.

Jaubert (French Pat. No. 07695, 1973) describes a card having two sheets with a single sheet of carbon paper held therebetween. The carbon paper hides a message from view.

Weinschenk (U.S. Pat. No. 2,365,789; 1942) describes a postcard upon which a typewritten message can be made without removing the card from the typewriter. A single sheet of carbon paper is placed between the card and a second sheet of paper.

James (U.S. Pat. No. 2,831,707; 1955) describes a check and envelope assembly between which a sheet of carbon paper may be placed to reproduce any written material, and thus aid in record keeping.

SUMMARY OF THE INVENTION

In a first aspect, the invention features a postcard assembly comprising a first, second, and third sheet, the sheets being arranged one on top of another, with adjacent sheets removably attached together. The first and second sheets have first and second upper and first and second lower surfaces, and the first and second lower surfaces comprise pressure sensitive material, wherein pressure on this material causes a visible mark to be formed on a sheet positioned below the first or second lower surface. The third sheet is adapted to be mailed as a postcard with the second sheet removably attached to the third sheet and with the second sheet obscuring any visible mark on the third sheet.

In preferred embodiments, only half of the first lower surface comprises the pressure sensitive material; only half of the second lower surface comprises this material; the first sheet is removable from the second and third sheets; the second and third sheets are fixed together along their edges; and the second upper surface is adapted for mailing as a postcard.

In a second aspect, the invention features a postcard assembly comprising a first, second and third sheet, the sheets being arranged one on top of another, with adjacent sheets removably attached together. The third sheet has an upper and lower surface, and the upper surface has imprint recording pressure sensitive material, wherein pressure on the material results in a corresponding visible mark to be formed on the material. The third sheet is adapted to be mailed as a postcard with the second sheet removably attached to the third sheet and with the second sheet obscuring any visible mark on the third sheet. The second and third sheets form a mailable assembly mailable at postcard rate having an address portion for displaying upon mailing, the address of the recipient and a confidential message portion opaquely covered by at least a portion of the second sheet, the confidential message portion being visible upon removing the second sheet from the third sheet.

In preferred embodiments, less than half of the upper surface is pressure sensitive material; the material is NCC paper; the first sheet is removable from the second and third sheets; the second and third sheets are fixed together along their edges; and the lower surface is adapted for mailing as a postcard.

This invention provides a postcard assembly which allows confidential information to be sent to people at postcard postage rates. One sheet of the assembly is used for record keeping, another is used to obscure information on the third sheet, and the third to relay the confidential information. This assembly is useful in many areas of life, ranging from doctors confirming patent appointments, to teachers reporting school grades.

Other features and advantages of the invention will be apparent from the following description of the preferred embodiment, and from the claims.

DESCRIPTION OF THE PREFERRED EMBODIMENTS

The Figures will first briefly be described.

DRAWINGS

STRUCTURE

Figure 1:
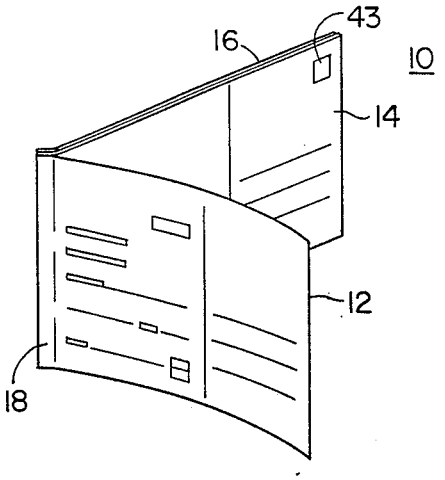
FIG. 1 is a perspective view of a postcard assembly.
Figure 2:
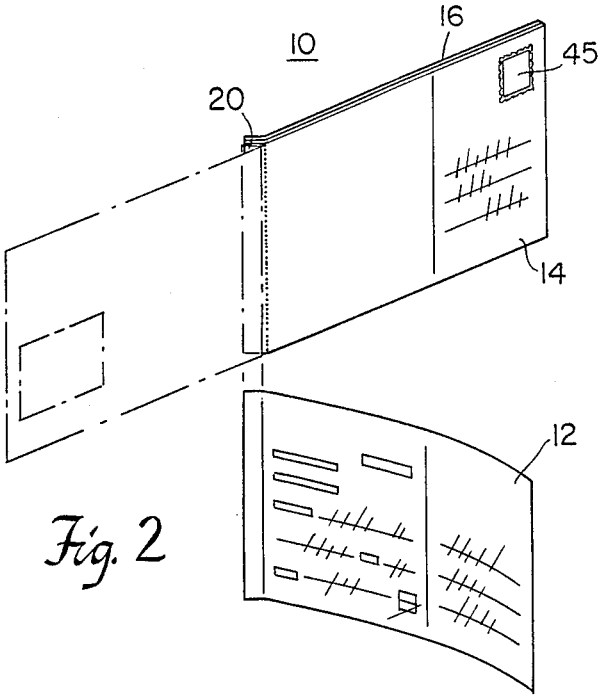
FIG. 2 is a diagrammatic representation of an assembly having its top sheet removed.
Figure 3A:
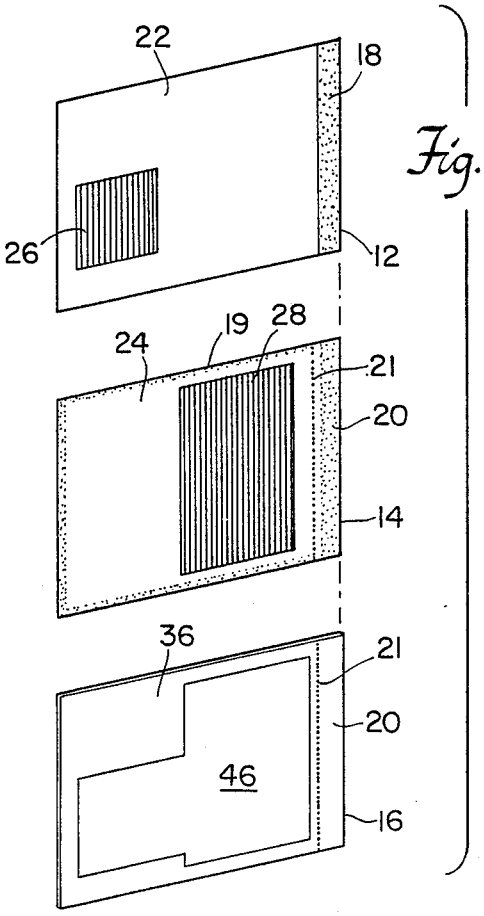
FIGS. 3 and 3A are respectively upper and lower surface exploded views of a postcard assembly.
Figure 3:
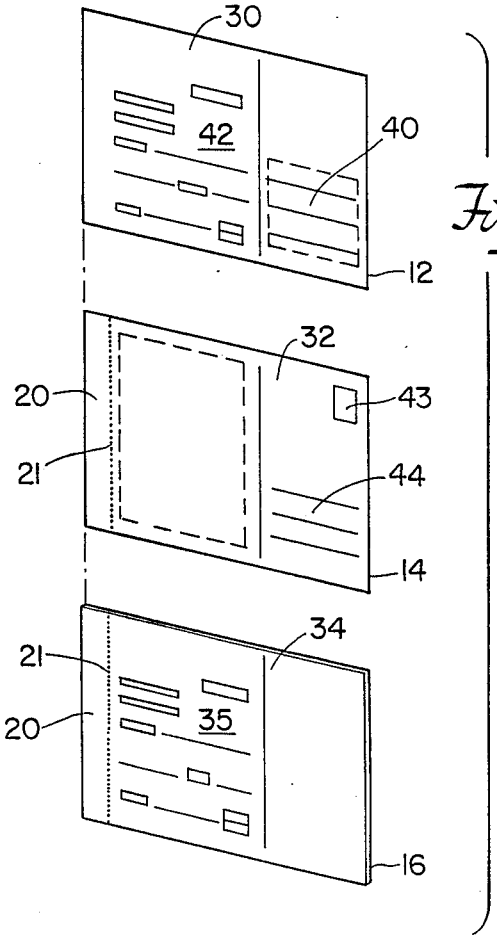

Referring to FIGS. 1–3, assembly 10 is provided with three sheets, 12, 14 and 16. Upper sheet 12 is temporarily attached to middle sheet 14 along area 18 with adhesive. The adhesive allows ready removal of upper sheet 12 from middle sheet 14. Such removal is shown in FIG. 2. Middle sheet 14 and lower sheet 16 are attached by adhesive 19 along their four edges to form a closed envelope, and have a removable portion 20 joined to the main part of each sheet 14, 16 at a serrated edge 21.

The lower surfaces 22, 24 of upper sheet 12 and middle sheet 14, respectively, are provided with pressure sensitive copying material 26, 28 such as carbon paper to allow a copy of material written on upper sheet 12 to be formed on the sheets below. This material is positioned so that only some of the writing on upper sheet 12 is copied onto the lower sheets. Thus, upper sheet 12 has only a small area of NCC material, corresponding to the address area of a postcard; and middle sheet 14 has only half of its area as NCC material 28.

The upper surface 30 of upper sheet 12 is provided with an area 40 suitable for writing the address of the sendee, and an area 42 suitable for recording confidential information. The address will be copied onto area 44 of the upper surface 32 of middle sheet 14 while the confidential information is copied only onto the upper surface 34 in area 35 of lower sheet 16. Middle sheet 14 is provided with an area 43 suitable for placing a stamp 45.

The lower surface 36 of lower sheet 16 is also provided with an area 46 having a pattern, such as a picture, suitable to obscure any writing on upper surface 34. Lower sheet 16 is also thicker than the other sheets 12, 14 having a thickness of about 0.5 mm compared to the 0.2 mm thickness of sheets 12, 14.

Assembly 10 is manufactured using standard procedures. At least lower sheet 16 is made from material which does not retain pressure marks from writing on upper sheet 12.

Figure 4A:
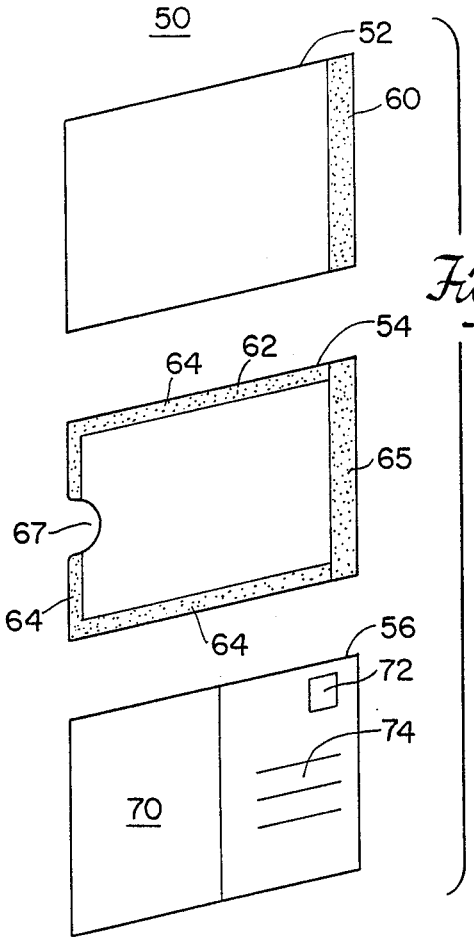
FIGS. 4 and 4A are respectively upper and lower surface exploded views of an alternative postcard assembly.
Figure 4B:
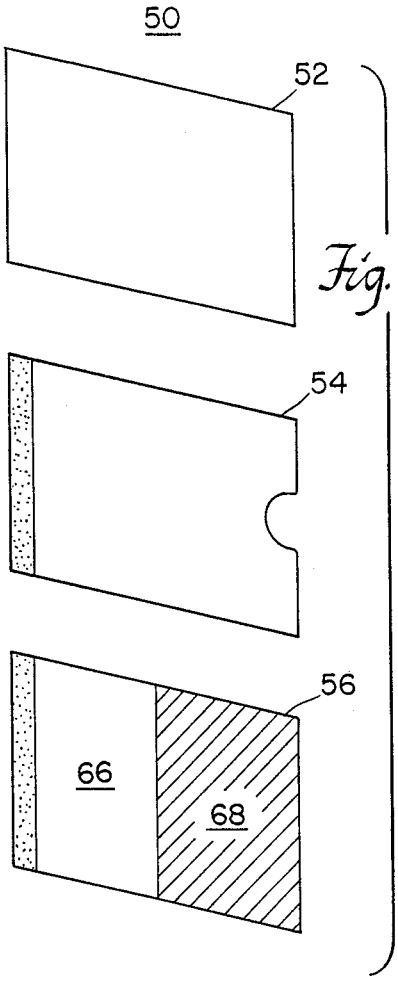

Referring to FIGS. 4–4A, in a second embodiment, assembly 50 is provided with 3 sheets, 52, 54 and 56. Upper sheet 52 is temporarily attached to sheet 54 along area 60 with adhesive, thereby permitting ready removal of sheet 52, much as shown for sheet 12 in FIG. 2. Sheets 54 and 56 are held together by adhesive 62 along three edge regions 64 and along one side region 65 to form a closed envelope. Middle sheet 54 has a small semicircular cutout 67 suitable for allowing insertion of a finger for separation of sheets 54 and 56.

The upper surface 66 of sheet 56 is provided with an imprint recording pressure sensitive material 68 such as non-carbon carbon (NCC) paper. This material covers the right half of sheet 56.

Lower surface 70 of sheet 56 is provided with an area 74 suitable for writing the address of the sendee, and an area 72 suitable for positioning a stamp.

USE

Referring to FIGS. 1–3, any writing that is made on upper sheet 12 is selectively transferred to the middle or lower sheets 14, 16 by carbon paper. Upper sheet 12 is used by the sender as a file copy to record what was sent on lower sheets 14, 16. It is detached before mailing the lower two sheets. Middle sheet 14 acts to cover confidential information written on the sheet 16 below, and to address the postcard. A stamp may be placed on this sheet. The upper surface of the lower sheet 16 is revealed only when the sendee tears along perforation 21 and peels the middle and lower sheets apart. At this point the confidential information can be read.

Referring to FIGS. 4 and 4A, any writing on the right hand area of sheet 52 will be recorded as an image on recording pressure sensitive area 68 of sheet 56. After the confidential information is written on sheet 52 and thereby recorded on sheet 56, the sender removes sheet 52, which serves as a file copy for this records. Sheet 54 acts to cover the confidential information recorded on sheet 56. The address of the sendee is written in area 74 on the lower side of sheet 56. The assembly is then stamped and mailed at postcard rate.

OTHER EMBODIMENTS

Other embodiments are within the following claims. For example, the positioning of carbon paper or NCC material can be varied according to the specific use that the sendor has. Further, the middle sheet may be provided with decorative material on the upper surface to obscure information on lower sheets.

I claim:

1. A postcard assembly comprising, a first, second, and third sheet, said sheets being arranged one on top of another, with adjacent sheets removably attached together, wherein said first and second sheets have first and second upper and first and second lower surfaces, said first and second lower surfaces comprising pressure sensitive material, wherein pressure on said material causes a visible mark to be formed on a sheet positioned below said first or second lower surface, and wherein said third sheet is adapted to be mailed as a postcard with said second sheet removably attached to said third sheet and with said second sheet obscuring said visible mark on said third sheet, said second and third sheets forming a mailable assembly mailable at postcard rate having an address portion for displaying upon mailing, the address of the recipient and a confidential message portion opaquely covered by at least a portion of said second sheet, said confidential message portion visible upon removing said second sheet from said third sheet.

2. The assembly of claim 1, wherein less than half of said first lower surface comprises said material.

3. The assembly of claim 1 or 2 wherein less than half of said second lower surface comprises said material.

4. The assembly of claim 1 wherein said first sheet is removable from said second and third sheets.

5. The assembly of claim 1 wherein said second and third sheets are fixed together along their edges.

6. The assembly of claim 5 wherein said second upper surface overlays said address portion.

7. A postcard comprising a first, second and third sheet, said sheets being arranged one on top of another, with adjacent sheets removably attached together, wherein said third sheet has an upper and lower surface, said upper surface comprising imprint recording pressure sensitive material, wherein pressure on said material results in a corresponding visible mark to be formed on said material, and wherein said third sheet is adapted to be mailed as a postcard with said second sheet removably attached to said third sheet and with said second sheet obscuring said visible mark on said third sheet, said second and third sheets forming a mailable assembly mailable at postcard rate having an address portion for displaying upon mailing, the address of the recipient and a confidential message portion opaquely covered by at least a portion of said second sheet, said confidential message portion visible upon removing said second sheet from said third sheet.

8. The assembly of claim 7, wherein less than half of said upper surface comprises said material.

9. The assembly of claim 7, wherein said first sheet is removable from said second and third sheets.

10. The assembly of claim 7 wherein said second and third sheets are fixed together along their edges.

11. The assembly of claim 7 wherein said lower third surface is adapted for mailing as a postcard.

12. The assembly of claim 7, said material being NCC paper.

13. A postcard assembly in accordance with claim 1 wherein said first and second upper surfaces overlay said first and second lower surfaces respectively and at least a portion of said first surfaces overlay said confidential message portion and at least a portion of said second surfaces overlay said address portion.

14. A postcard in accordance with claim 7 wherein said first and second sheets each have first and second portions overlaying said address and confidential portions respectively for receiving address information and confidential message information respectively with the confidential message and address information being recordable simultaneously upon both said first sheet and said mailable assembly to allow the sender to remove said first sheet prior to mailing said mailable assembly and retain a record of said confidential information and the address of said recipient on the removed first sheet.

* * * * *